US010767408B2

(12) United States Patent
Cloutier

(10) Patent No.: US 10,767,408 B2
(45) Date of Patent: Sep. 8, 2020

(54) GARAGE DOOR CARRIER SYSTEM

(71) Applicant: Hermel R. Cloutier, Wasaga Beach (CA)

(72) Inventor: Hermel R. Cloutier, Wasaga Beach (CA)

( * ) Notice: Subject to any disclaimer, the term of this patent is extended or adjusted under 35 U.S.C. 154(b) by 150 days.

(21) Appl. No.: 15/826,156

(22) Filed: Nov. 29, 2017

(65) Prior Publication Data

US 2019/0162001 A1 May 30, 2019

(51) Int. Cl.

| | |
|---|---|
| ***E05D 15/04*** | (2006.01) |
| ***E06B 3/34*** | (2006.01) |
| ***E06B 5/00*** | (2006.01) |
| ***E05F 7/06*** | (2006.01) |
| ***E05D 15/38*** | (2006.01) |
| ***E05F 1/02*** | (2006.01) |

(52) U.S. Cl.

CPC ..... *E05D 15/04* (2013.01); *E05D 15/38* (2013.01); *E05F 1/02* (2013.01); *E05F 7/06* (2013.01); *E06B 3/34* (2013.01); *E06B 5/00* (2013.01); *E05D 2700/12* (2013.01); *E05Y 2201/626* (2013.01); *E05Y 2201/684* (2013.01); *E05Y 2900/106* (2013.01)

(58) Field of Classification Search

CPC .. E05D 15/04; E05D 15/38; E05F 7/06; E05F 1/04; E05F 1/046; E05F 1/06; E06B 3/34

USPC ..... 49/200, 201

See application file for complete search history.

(56) References Cited

U.S. PATENT DOCUMENTS

| | | | | | |
|---|---|---|---|---|---|
| 2,293,462 | A * | 8/1942 | Haynes | E05D 15/403 | 49/200 |
| 2,575,201 | A * | 11/1951 | Tillotson | E05D 15/408 | 49/199 |
| 2,585,110 | A * | 2/1952 | Gramlich | E05D 15/403 | 70/145 |
| 2,759,226 | A * | 8/1956 | McKee | E05D 15/405 | 49/140 |
| 3,208,108 | A * | 9/1965 | Doring | E05D 15/408 | 49/205 |
| 3,348,336 | A * | 10/1967 | Hashagen | E05F 15/676 | 49/200 |
| 3,608,242 | A * | 9/1971 | Braun | E05F 13/04 | 49/280 |
| 3,631,628 | A * | 1/1972 | Bahnsen | E05F 15/59 | 49/200 |

(Continued)

FOREIGN PATENT DOCUMENTS

| | | | | |
|---|---|---|---|---|
| DE | 694448 C | * | 8/1940 | E05D 15/28 |

OTHER PUBLICATIONS

Translation_of_DE694448.pdf.*

*Primary Examiner* — Marcus Menezes

(57) ABSTRACT

A garage door carrier system carries an overhead garage door between a closed position blocking entry of a vehicle into a garage, and an open position allowing entry of the vehicle into the garage. The garage door is in rolling engagement with a track that guides the garage door. A lever, rotating about a pivot, has a counterweight at a first end and is rotatably connected to the garage door at a second opposite load end. The counterweight provides in-force at the first end that translates as out-force at the load end as the lever rotates about the pivot to carry the garage door between the closed position and the open position.

19 Claims, 10 Drawing Sheets

(56) References Cited

U.S. PATENT DOCUMENTS

| | | | | | |
|---|---|---|---|---|---|
| 3,839,827 | A * | 10/1974 | Dickinson | E05D 15/38 | 49/197 |
| 4,443,972 | A * | 4/1984 | Dolhaine | E05D 15/405 | 49/197 |
| 5,384,975 | A * | 1/1995 | Yuran | E05D 15/401 | 49/203 |
| 9,273,507 | B2 * | 3/2016 | Petrat | E05F 15/53 | |
| 9,677,314 | B2 * | 6/2017 | Houser | E05F 15/59 | |

* cited by examiner

GARAGE DOOR CARRIER SYSTEM

TECHNICAL FIELD

This relates to overhead garage doors, in particular, a system and method for carrying an overhead garage door between a closed position and an open position.

BACKGROUND

Conventional garage doors may be formed of a single panel, or as a sectional garage door, may be formed of two or more jointed panels.

Standard garage door sizes commonly used in the garage door industry may be characterized as single, double or commercial. A double garage door may, for example, have a measurement of 16 feet wide by 7 feet high, and have a mass of up to 225 pounds. Commercial garage doors may measure up to 32 feet in width and up to 24 feet in height.

A number of techniques exist to move a garage door between a closed position and an open position. For example, a single panel garage door may tilt between a closed position and an open position using jamb-type hardware to swing up and overhead with a hinge on each side. Alternatively, a sectional garage door may have rollers that follow along a track and may be actuated by a hinge on each side of the garage door. The sectional garage door may move between a closed position and an open position overhead along a track, and the jointed panels articulate as the door moves between a closed and open position.

Mechanisms used to operate movement of a sectional garage door between a closed position and an open position may also be spring-loaded. For example, in a torsion spring lift mechanism, a torsion spring is attached to cable drums that are above each end of the garage door. The cable drums turn as the torsion spring unwinds, pulling up cables that are affixed to the bottom of each end of the garage door. As the cables wrap around the cable drums, the garage door lifts and the panels roll along an arcuate track from a vertical section to an overhead horizontal section. As the garage door rises and the torsion spring unwinds, the weight of the door is transferred to the horizontal section of the track.

An extension spring lift mechanism acts as a counterbalance to the mass of a sectional garage door. In a closed position, the spring is extended to its longest length, and when moved into a vertical position, a cable runs via a pulley system between the spring and the bottom of the garage door to lift the garage door as the spring contracts. As the garage door rises, the panels of the garage door roll along an arcuate track from a vertical section to an overhead horizontal section.

Such traditional garage door openers have a number of moving parts, including springs, cables, and pulleys, that are vulnerable to break down from normal operating wear. A commercial underground parking garage may require thousands of cycles of closing and opening of a garage door per year. The strain on such traditional systems may cause hundreds of breakdowns, causing downtime, and tens of thousands of dollars in repairs a year to keep operational.

Accordingly, there is a need for a way to move a garage door between a closed position and an open position with a longer lifespan, less downtime, and reduced operating and repair costs.

SUMMARY

According to an aspect, there is provided a carrier system for carrying a garage door between a defined closed position in which the garage door is generally vertical and blocks entry of a vehicle into a garage through an opening, and a defined open position in which the garage door is generally horizontal and allows entry of the vehicle into the garage through the opening, the carrier system comprising: a track for guiding the garage door by rolling engagement with the track; a lever rotatable about a pivot, the lever having an in-lever arm at a first side of the pivot and an out-lever arm at a second, opposing, side of the pivot, the out-lever arm extending from the pivot to a load end, the load end rotatably connected to the garage door; and a counterweight connected to the in-lever arm to provide in-force at the in-lever arm, translated as out-force at the load end of the out-lever arm, as the lever rotates about the pivot, to carry the garage door between the defined closed position and the defined open position.

According to another aspect, there is provided a method of carrying a garage door between a defined closed position in which the garage door is generally vertical and blocks entry of a vehicle into a garage, and a defined open position in which the garage door is generally horizontal and allows entry of the vehicle into the garage, comprising: rotating a lever about a pivot, the lever having an in-lever arm at a first side of the pivot, an out-lever arm at a second, opposing, side of the pivot and rotatably connected to the garage door at a load end, and a counterweight connected to the in-lever arm, wherein the counterweight provides in-force at the in-lever arm, translated as out-force at the load end of the out-lever arm, as the lever rotates about the pivot, to carry the garage door between the defined closed position to the defined open position.

Other features will become apparent from the drawings in conjunction with the following description.

BRIEF DESCRIPTION OF THE DRAWINGS

In the figures which illustrate example embodiments.

Like reference numerals in the description refer to like elements in the drawings.

DETAILED DESCRIPTION

Figure 1:
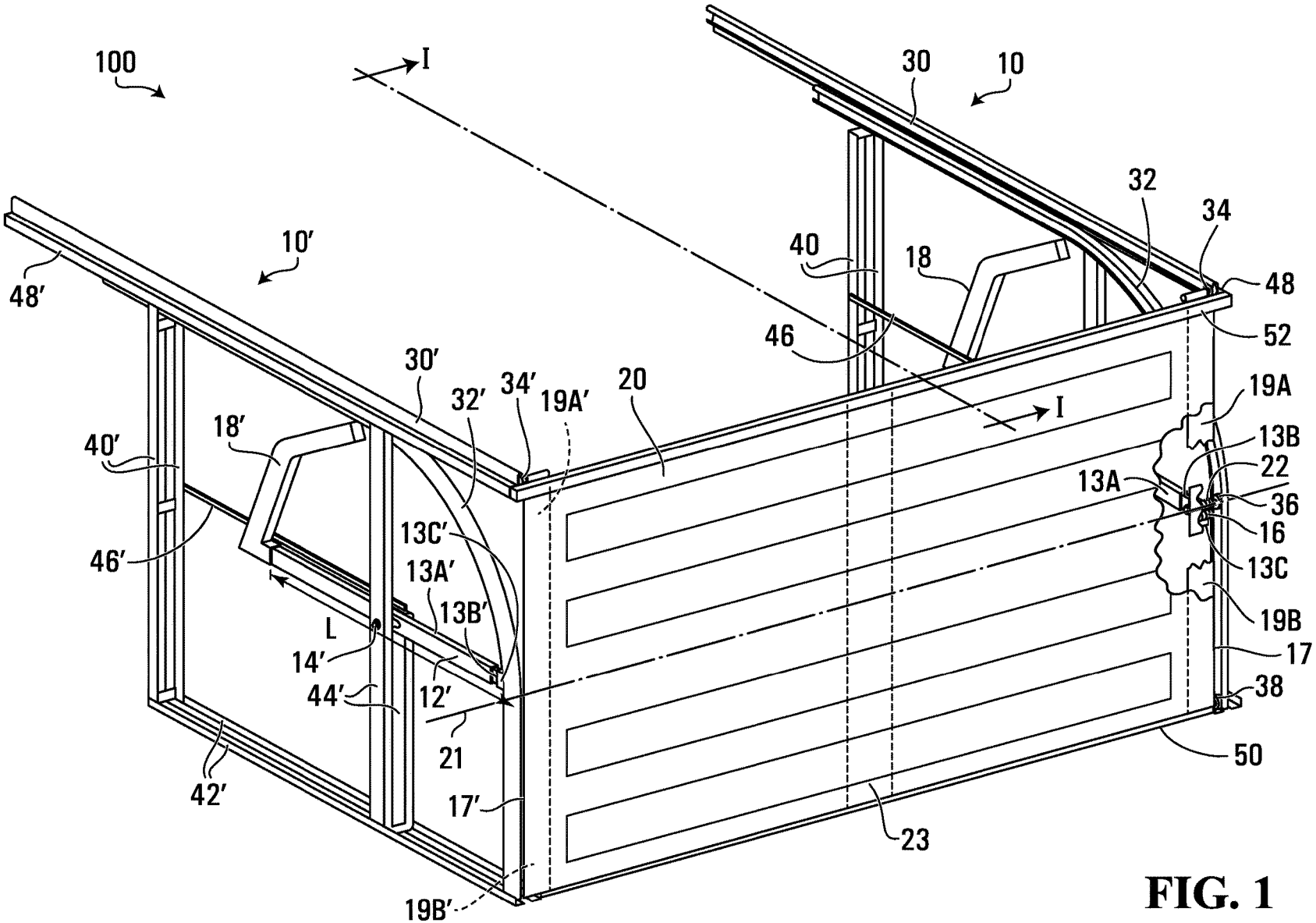
FIG. 1 is a schematic top left view of a garage door carrier system in a closed state, with a garage door in a closed position, exemplary of an embodiment.
Figure 2:
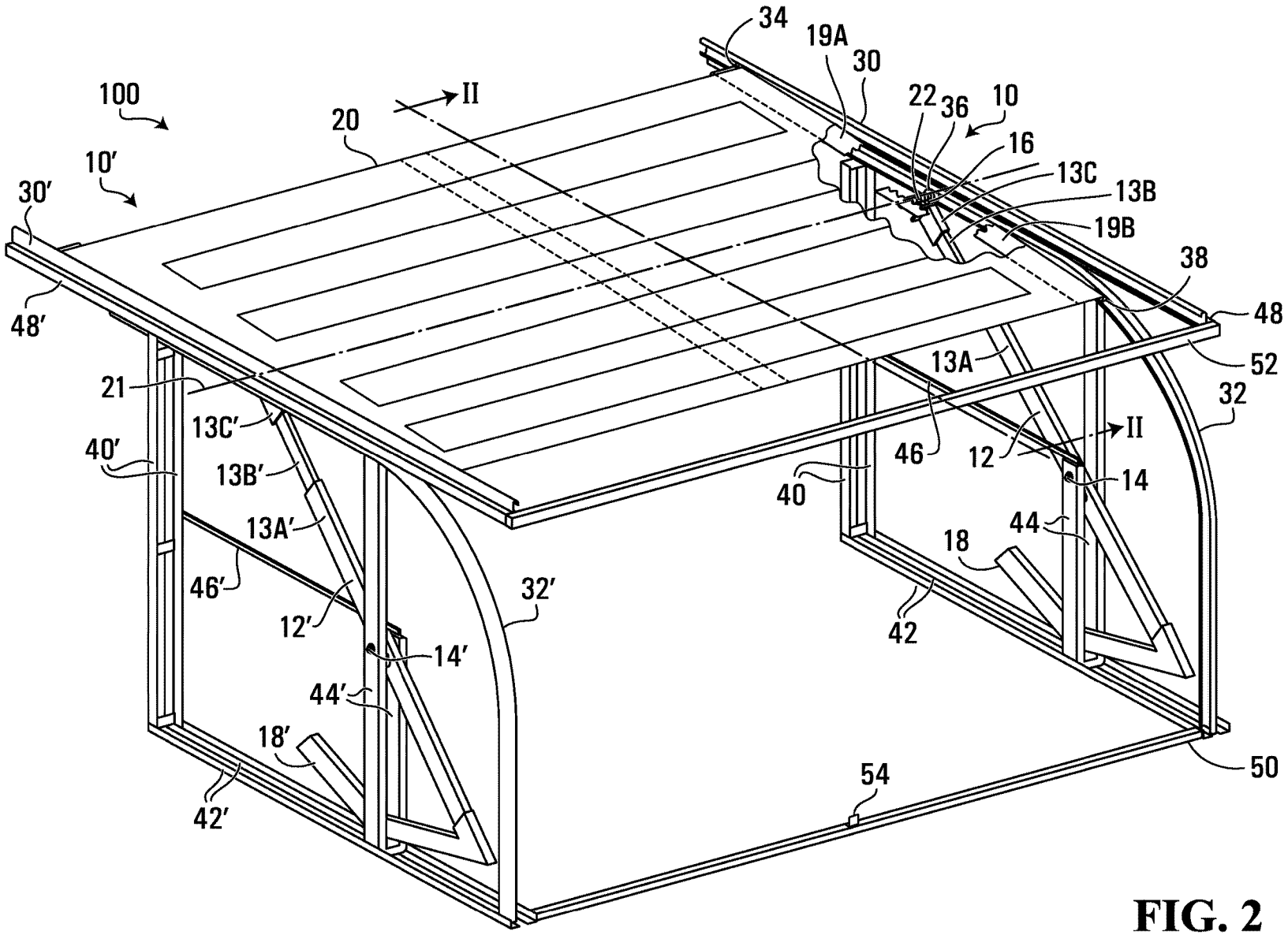
FIG. 2 is a schematic top left view of the garage door carrier system of FIG. 1 in an open state with the garage door in an open position.
Figure 3:
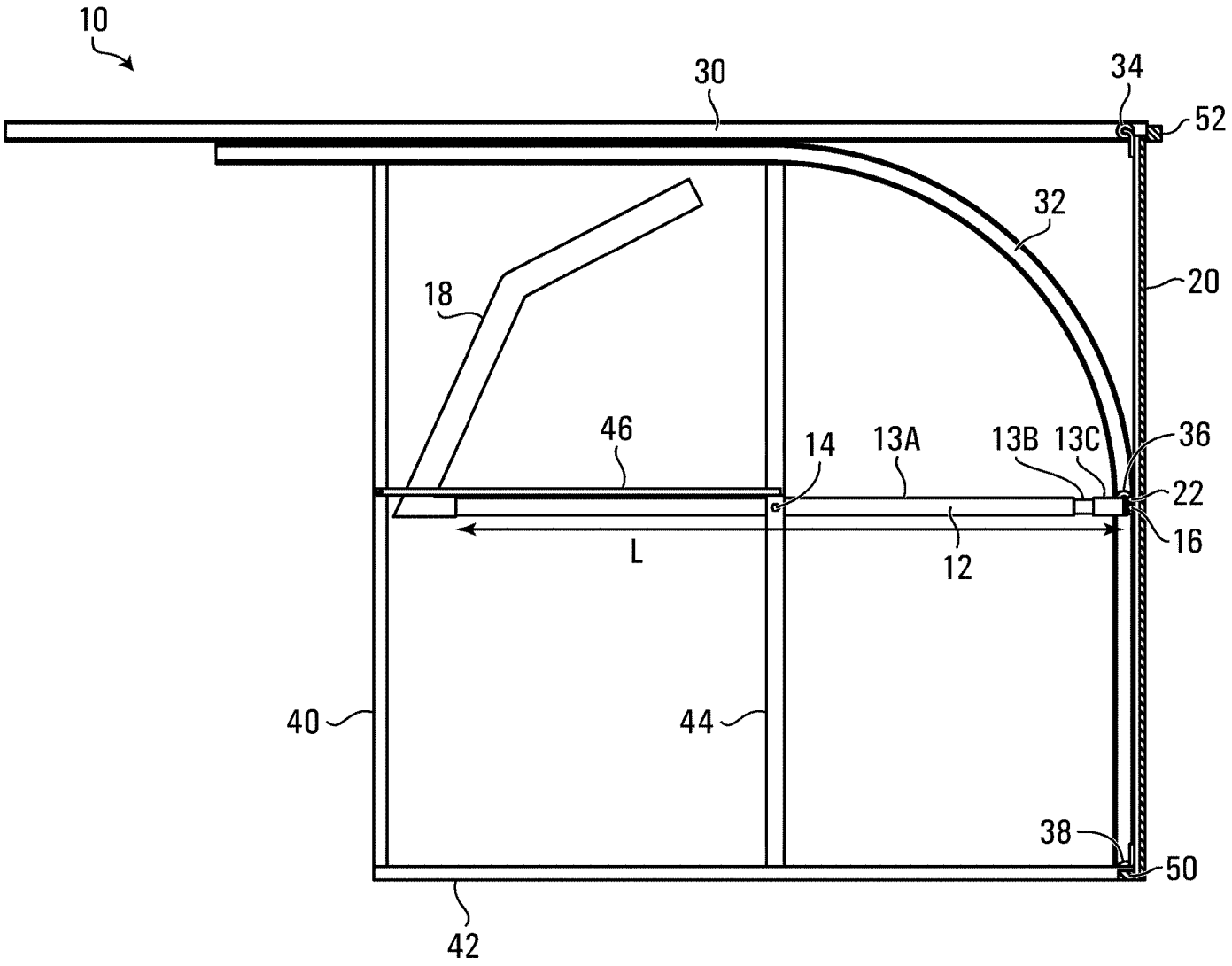
FIG. 3 is a cross-sectional view taken along lines I-I of the garage door carrier system of FIG. 1 in the closed state.
Figure 4:
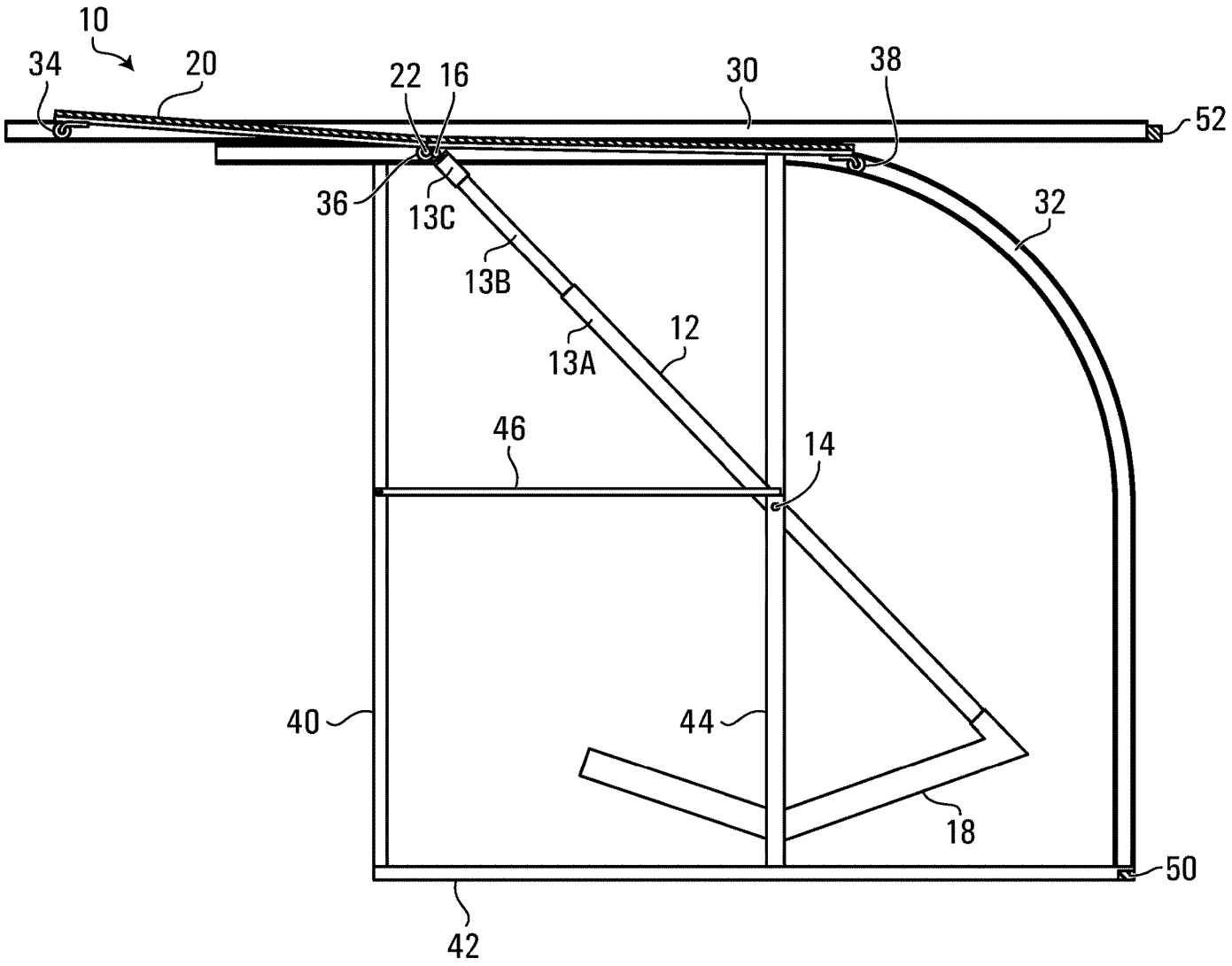
FIG. 4 is a cross-sectional view taken along lines II-II of the garage door carrier system of FIG. 2 in the open state.

FIG. 1 is a schematic top left view of a garage door system 100 in a closed state and a garage door 20 in a closed position, exemplary of an embodiment. Garage door system 100 includes garage door carriers 10 and 10'. FIG. 1 illustrates an example of a closed state of garage door system 100, in which garage door carriers 10, 10' position garage door 20 in an example of a closed position. FIG. 2 is a schematic top left view of garage door carrier system 100 in an open state with garage door 20 in an open position. FIG. 2 illustrates an example of an open state of garage door system 100, in which garage door carriers 10, 10' position garage door 20 in an example of an open position. FIG. 3 is a cross-sectional view taken along lines I-I of the garage door carrier system 100, in particular, illustrating garage door carrier 10 in the closed state. FIG. 4 is a cross-sectional view taken along lines II-II in FIG. 2 of garage door carrier system 100, in particular, illustrating garage door carrier 10 in the open state.

The closed state of garage door carrier system 100 and garage door carrier 10, as seen in FIGS. 1 and 3, may be pre-defined as a state in which garage door 20 is in a defined closed position. In the defined closed position, garage door 20 does not permit a vehicle to pass through an opening defined by the height and width measurements of garage door 20, for example, by not permitting a vehicle to enter a garage through the opening. The defined closed position of garage door 20 may also be defined as garage door 20 touching the floor or ground.

The open state of garage door carrier system 100 and garage door carrier 10, as seen in FIGS. 2 and 4, may be pre-defined as a state in which garage door 20 is in a defined open position. In the defined open position, garage door 20 permits a vehicle to pass through the opening, for example, to enter the garage.

As shown in FIGS. 1 and 2, garage door carriers 10, 10' are each positioned adjacent to a side of the opening, generally out of the path of a vehicle that may pass through the opening.

Garage door carrier 10 includes a top horizontal track 30 and an arcuate track 32 curving from a vertical section at ground level to a horizontal section adjacent top horizontal track 30. Top horizontal track 30 and arcuate track 32 guide garage door carrier 10 between the closed state with garage door 20 in the closed position (for example, as shown in FIG. 1), and the open state with garage door 20 in the defined open position (for example, as shown in FIG. 2).

Garage door carrier 10 includes a lever arm 12 that rotates about a pivot 14. An out-lever arm of lever arm 12 extends forward from pivot 14 to a load end at hinge 16. Lever arm 12 is rotatably connected by a hinge 16 to garage door 20 at an end. An in-lever arm of lever arm 12 extends rearwardly from pivot 14 to counterweight 18. A counterweight 18 is connected to lever arm 12, for example, at an end opposite hinge 16.

Rotation of lever arm 12 about pivot 14 rotates garage door carrier 10 between the closed state with garage door 20 in the closed position (for example, as shown in FIG. 1) and the open state with garage door 20 in the open position (for example, as shown in FIG. 2). Garage door 20 moves between the closed position and the open position as guided by top horizontal track 30 and arcuate track 32, as discussed in further detail below.

Lever arm 12 may be formed from structural tubing, for example, a metal with a hollow tubular cross section. Lever arm 12 may be formed, for example, from steel square tubing that is rectangular in cross-section. In other embodiments, lever arm 12 may be formed of material that is circular, cylindrical, square or rectangular in cross-section.

As shown in FIGS. 1 to 4, lever arm 12 may be extendible. Lever arm 12 may include an outer tubing member 13A that includes a hollow cavity, sized to receive at least part of a first end of the length of an internal tubing member 13B. Internal tubing member 13B can slide freely lengthwise to extend and retract within the hollow cavity of outer tubing member 13A, to extend or retract length L of lever arm 12 while in use. At a second, opposite end of internal tubing member 13B, a tubing member 13C is affixed. Tubing member 13C may be the same diameter as outer tubing member 13A and attach to hinge 16. The length L of lever arm 12 may extend as door carrier 10 moves from the closed state to the open state, as seen in FIGS. 2 and 4 and explained in further detail below.

In some embodiments, the length L of lever arm 12 may be adjustable for different sized garage doors by nesting an adjustable internal tubing member within outer tubing member 13A in a similar manner as described above in extending length L of lever arm 12. The adjustable internal tubing member may be nested within outer tubing member 13A on the opposite side of pivot 14 from internal tubing member 13B. The adjustable internal tubing member may have holes that line up with holes in outer tubing member 13A, and adjustable internal tubing member may be affixed to outer tubing member 13A by use of a common fastener, for example, a nut and bolt received through aligned holes in the adjustable internal tubing member and outer tubing member 13A, as would be understood by a person skilled in the art, such that length L of lever arm 12 may be adjusted and set.

Lever arm 12 rotates about pivot 14. As shown in FIGS. 1-4, pivot 14 is to the rear of where lever arm 12 connects to garage door 20. As shown in more detail in FIG. 5, pivot 14 may be formed by bearings, for example, flange bearings 15A, 15B, affixed, for example with bolts, to lever arm 12. A pivot pin 15C extends through lever arm 12 and flange bearings 15A, 15B. Pivot pin 15C may be a one inch diameter solid pin. Pivot pin 15C is retained in place at each end, for example, by lock collar 15D (only shown at one end) or a lock ring, and may be supported by a central vertical frame 44, discussed in further detail below.

Figure 6:
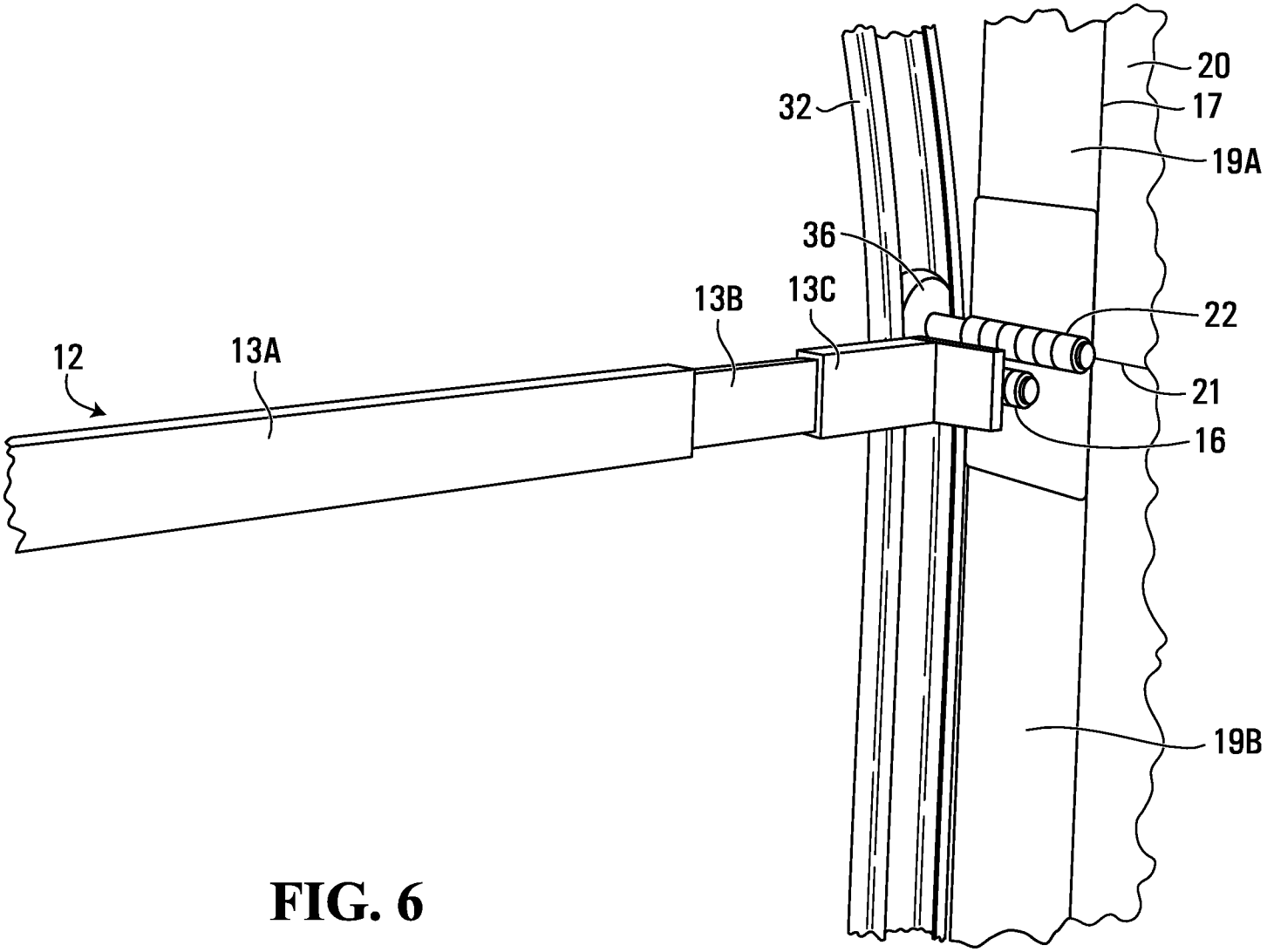
FIG. 6 is a perspective view of the lever arm rotatably connected to the garage door of the garage door carrier system of FIG. 3 in the closed state.
Figure 7:
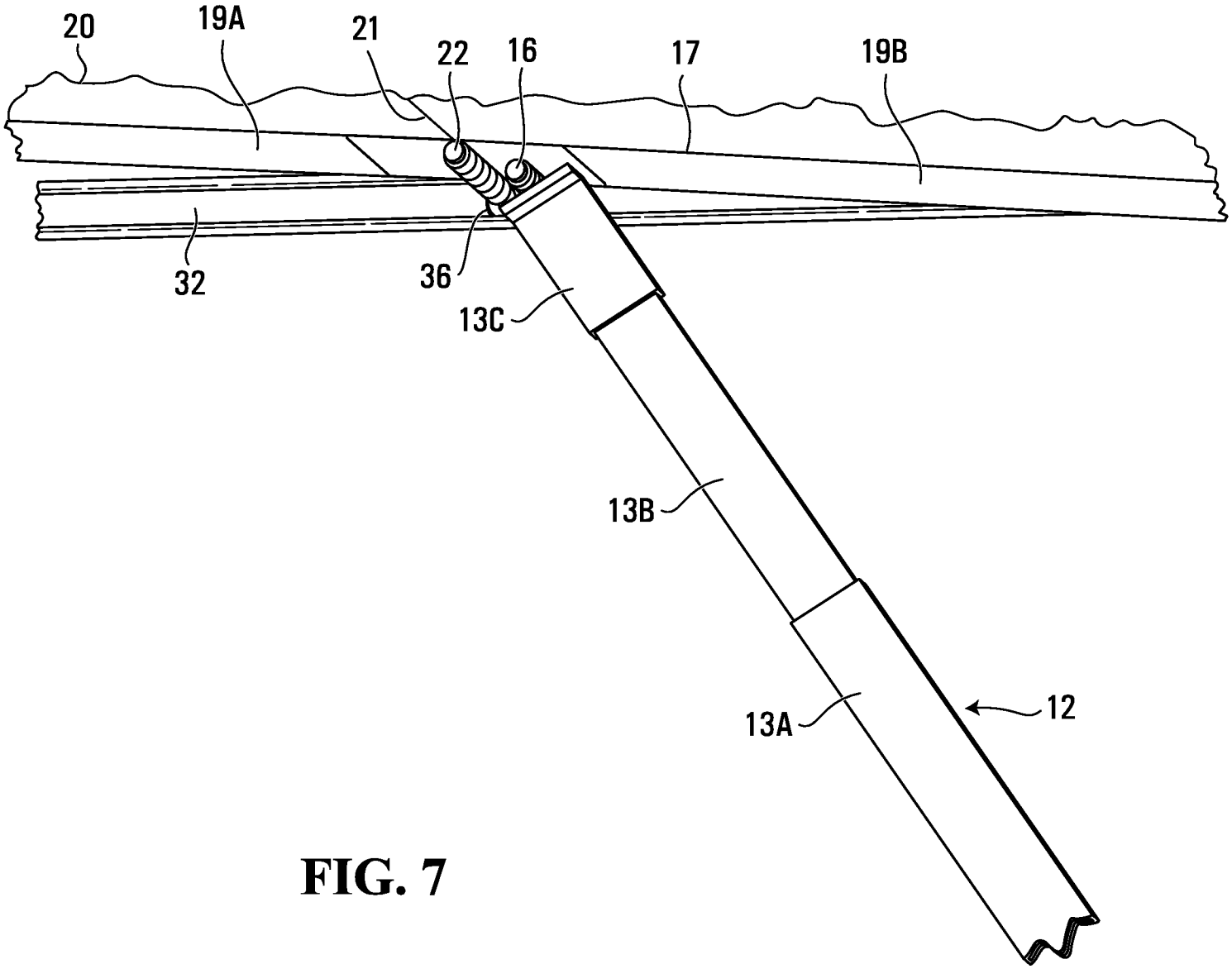
FIG. 7 is a perspective view of the lever arm rotatably connected to the garage door of the garage door carrier system of FIG. 4 in the open state.

Hinge 16 rotatably connects lever arm 12 to garage door 20. FIG. 6 is a perspective view of lever arm 12 rotatably connected by hinge 16 to garage door 20 in the closed state. FIG. 7 is a perspective view of lever arm 12 rotatably connected by hinge 16 to garage door 20 in the open state. Hinge 16 may be formed of a set of sealed bearings rigidly fixed to lever arm 12, and sealed bearings rigidly fixed to garage door 20, the sets of sealed bearings mated by a pin. In other embodiments, hinge 16 may be formed in other configurations that allow garage door 20 to articulate with reference to lever arm 12. Hinge 16 is illustrated in FIGS. 6 and 7 as part of hinge mechanism 17. Hinge mechanism 17 includes mounting plates 19A, 19B and garage door hinge 22 that is attached to mounting plates 19A, 19B.

Garage door hinge 22 articulates about an axis 21 and is affixed to mounting plate 19A and 19B on each side of the hinge, and supports garage door 20 as it articulates about axis 21.

Garage door 20 attaches to mounting plates 19A, 19B. In some embodiments, as shown in FIGS. 1 and 2, mounting plates 19A, 19B may be a generally flat steel plate, to which garage door 20 is affixed by conventional means such as nut and bolt (not shown). In other embodiments, mounting plates 19A, 19B may be structured as a concave channel to receive garage door 20, and formed, for example, from square steel tubing. Mounting plates 19A, 19B may be, for example, between 1 and 5 inches in width, and extend part of or the complete height of garage door 20, as shown in FIGS. 1 and 2.

In the embodiment shown in FIGS. 6 and 7, hinge 16 is mounted adjacent to garage door hinge 22. In some embodiments, hinge 16 may be formed integrally with garage door hinge 22.

Figure 8:
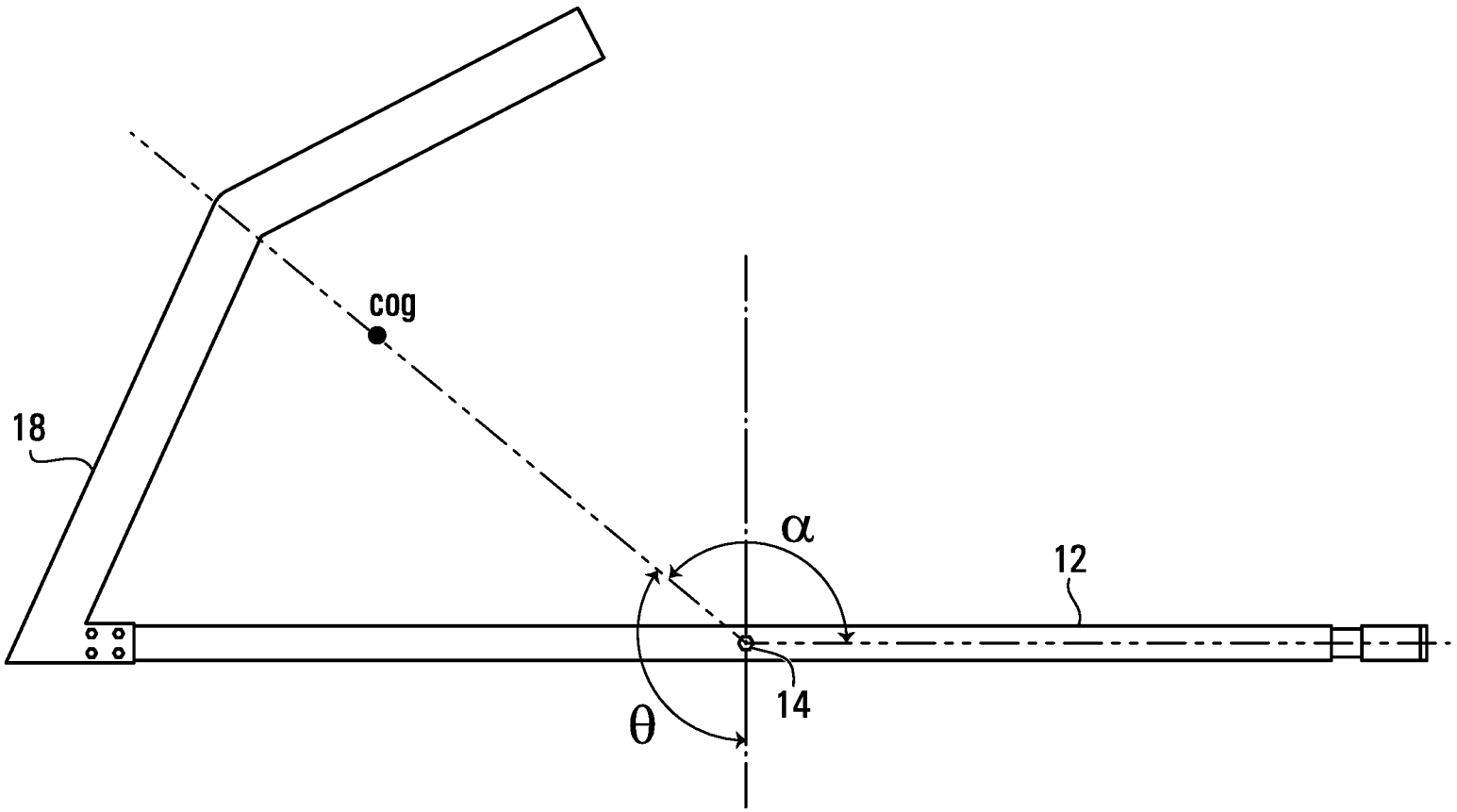
FIG. 8 is a left elevation view of the lever arm and the counterweight of the garage door carrier system of FIG. 3 in the closed state.

Returning to FIG. 1, lever arm 12 may extend rearwardly beyond pivot 14, to an end at which counterweight 18 is affixed, such that counterweight 18 is to the rear of pivot 14 and garage door 20. Counterweight 18 may be affixed to lever arm 12 by nuts and bolts, as shown in FIG. 8. In other embodiments, counterweight 18 may be affixed to lever arm 12 by any other suitable method, as would be understood by a person skilled in the art. In other embodiments, counterweight 18 may be formed as an integral component with lever arm 12.

In some embodiments, counterweight 18 may be mounted to lever arm 12 at a distance from pivot 14 that is equal to the distance between pivot 14 and hinge 16 which connects lever arm 12 to garage door 20.

In some embodiments, counterweight 18 may extend from pivot 14 at a distance that is less than the distance from pivot 14 to the bottom extent of garage door carrier 10, or the ground.

The shape of the counterweight 18 may be dictated by a desired location of the centre of gravity of counterweight 18 in combination with the centre of gravity of the portion of lever arm 12 that is to the rear of pivot 14. As shown in FIG. 1, counterweight 18 may be v-shaped from a side view. In other embodiments, counterweight 18 may be u-shaped in side view, or straight, or in a shape that provides a desired centre of gravity.

Counterweight 18 may be formed from a solid object, or structural tubing with a hollow cross-section or a u-shape in cross-section.

In some embodiments, counterweight 18 includes an accessible hollow cavity in which weights may be placed inside, and affixed with a pin and lock through a distal end of counterweight 18. In this way, the mass of counterweight 18 may be adjustable. In some embodiments, the mass of counterweight 18 may be a quarter of the mass of garage door 20. As such, the ratio of the mass of counterweight 18 to the mass of garage door 20 may be, for example, 1:4. For example, counterweight 18 may have a mass of 55 pounds, and garage door 20 may have a mass of 225 pounds.

In some embodiments, the ratio of the mass of counterweight 18 to the mass of garage door 20 may be varied to compensate for the distance from counterweight 18 to pivot 14, and the distance from hinge 16 (where lever arm 12 connects to garage door 20) to pivot 14. For example, due to the characteristics of a lever, increasing the distance between counterweight 18 and pivot 14 may allow for the mass of counterweight 18 to be reduced. Similarly, decreasing the distance between counterweight 18 and pivot 14 may lead to an increase in the mass of counterweight 18. The ratio of the mass of counterweight 18 to the mass of garage door 20 may also be dependent on the rotational force intended to be applied to lever arm 12 (in operation, as discussed below), as increasing the mass of counterweight 18 reduces the amount of rotational force required to rotate garage door carrier 10.

As shown in FIG. 8, counterweight 18 is mounted to lever arm 12 at an angle θ, defined as an obtuse angle between a reference axis passing through the centre of gravity "cog" of counterweight 18 and pivot 14 and a vertical axis passing through pivot 14.

Counterweight 18 is mounted to lever arm 12 at an angle θ so that as garage door carrier 10 carries garage door 20 between the closed position and the open position, the "cog" of counterweight 18 may rotate through angle θ that is equal to an obtuse travel angle (illustrated as angle β in FIG. 10) of the out-lever of lever arm 12 as it rotates about pivot 14 between the closed state, in which garage door 20 is in closed position, and the open state, in which garage door 20 is in the open position.

In some embodiments, angle θ may be greater than 90°, for example, between 90° and 180°. In some embodiments angle θ may be between 120° and 150°, for example, angle θ may be 130° as shown in FIG. 8.

A mounting angle α is defined as the angle between a reference axis passing through the "cog" (the combined centre of gravity of counterweight 18 and the portion of lever arm 12 that is to the rear of pivot 14) and the axis of the length of lever arm 12 that extends from pivot 14 to the end of lever arm 12 to which hinge 16 is attached to rotatably connect to garage door 20.

In some embodiments, the out-lever arm of lever arm 12 is horizontal to the ground and is orthogonal to garage door 20 in the closed position, and the value in degrees of (180°−α) may be the angular rotation that in-lever arm of lever arm 12 continues past vertical before reaching the open state in which garage door 20 is in open position, as the lever arm 12 rotates between the closed state and the open state, discussed in further detail below. In the open position, the centre of gravity "cog" may be aligned with a vertical axis passing through pivot 14.

In some embodiments, mounting angle α may be greater than 90°, for example, between 90° and 180°. In some embodiments mounting angle α may be between 120° and 150°, in an embodiment, 140° as shown in FIG. 8.

In some embodiments, angle α may equal angle θ, for example, if both angle α and angle θ are equal to 135°.

Figure 9:
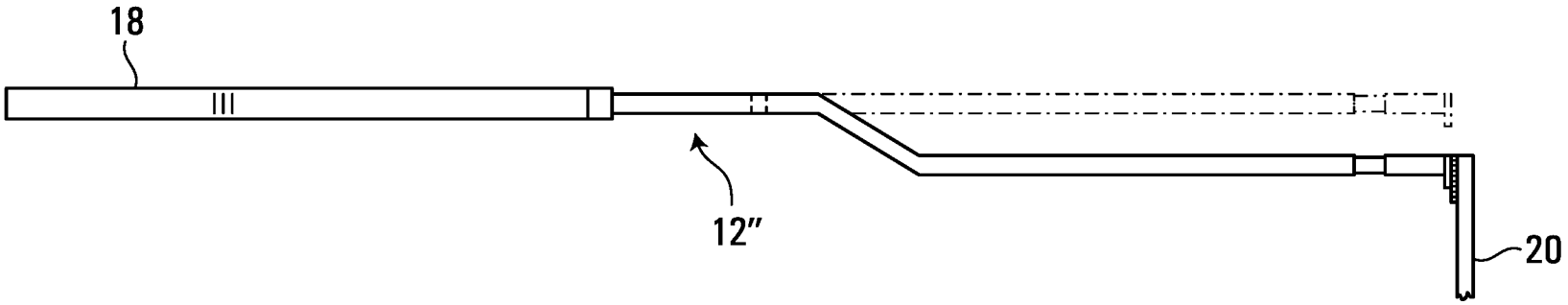
FIG. 9 is a top view of a lever arm, exemplary of an embodiment.

While lever arm 12 is illustrated in FIGS. 1 to 4 as a straight rigid arm, in some embodiments lever arm 12 may take other shapes. For example, FIG. 9 is a top view of a lever arm 12" which extends from pivot 14 to hinge 16 in the path of an s-bend. This shape may allow for garage door carrier 10 to be positioned offset from the opening, and align hinge 16 with garage door 20.

Garage door 20 may be any conventional garage door. In one example, garage door 20 may be 16 feet in width and 7 feet in height, and weigh 225 pounds. Garage door 20 shown in FIG. 1 has four panels, and can articulate along axis 21 aligned with garage door hinge 22 between the top two and bottom two panels. In other embodiments, garage door 20 may have two panels, or any number of panels, and may bend or be hinged at multiple points along the height of the door. In other embodiments, garage door 20 may be non-standard in size and weight.

In some embodiments, garage door hinge 22 may form part of garage door 20, omitting the remainder of hinge mechanism 17, and hinge 16 may connect directly to garage door 20.

In some embodiments, as shown in FIGS. 1 and 2, a supplementary hinge mechanism 23 may be installed at a midpoint halfway along the length of garage door 20. Supplementary hinge mechanism 23 may articulate about axis 21. Supplementary hinge mechanism 23 may have generally the same structure and components as hinge mechanism 17. Supplementary hinge mechanism may support garage door 20 where sections of garage door 20 articulate.

In other embodiments, one or more hinge mechanisms 23 may be installed at other points along the length of garage door 20.

A top roller 34, a middle roller 36 and a bottom roller 38 are connected to garage door 20 and are in rolling engagement with top horizontal track 30 and arcuate track 32. In the embodiment illustrated in FIGS. 1 to 4, garage door 20 engages with top horizontal track 30 with top roller 34. Garage door 20 engages with arcuate track 32 with middle roller 36 and bottom roller 38. Top roller 34, middle roller 36 and bottom roller 38 may be ball-bearing rollers formed of nylon or steel, known to a person skilled in the art. Top horizontal track 30 and arcuate track 32 are sized to accept top roller 34, middle roller 36 and bottom roller 38. The width of top horizontal track 30 and arcuate track 32 may be, for example, 1 inch, 2 inches, or 3 inches.

FIGS. 1 to 4 illustrate garage door carrier 10 as including two tracks, namely top horizontal track 30 and arcuate track 32. In some embodiments, garage door carrier 10 may comprise a single track, or other configurations of tracks to guide garage door 20 as it moves between a closed position and an open position. For example, top roller 34, middle roller 36 and bottom roller 38 may engage with a single arcuate track.

Figure 5:
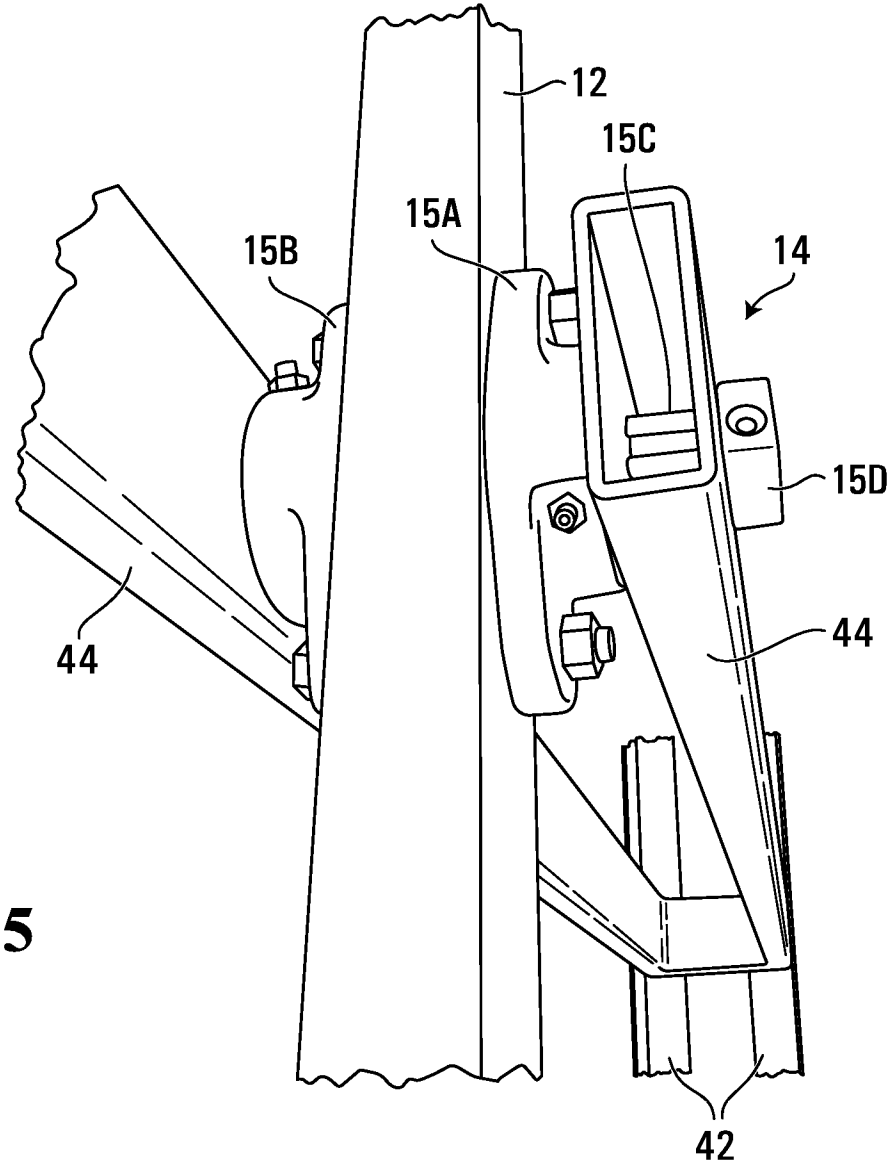
FIG. 5 is a top perspective view of a pivot of a lever arm of the garage door carrier system of FIG. 3 in the closed state.

As seen in FIGS. 5 and 6, middle roller 36 may have a pin integrally formed with the pin of garage door hinge 22. In some embodiments, middle roller 36 may have a pin that is integrally formed with the pin of hinge 16.

In some embodiments, garage door carrier 10 may be supported by a frame bracket, the components including a front vertical frame (not shown), a rear vertical frame 40, a lower horizontal frame 42, central vertical frame 44, a central horizontal frame 46, and an upper horizontal frame 48.

The components of the frame bracket may be formed, for example, from 1 inch by 3 inch square steel tubing. A portion of central vertical frame 44 in an embodiment can be seen in FIG. 7. In some embodiments, components of the frame bracket may be formed of 2 inches by 2 inches angle iron that is one eighth of an inch thick.

The components of the frame bracket may be formed in pairs. When formed in pairs, components of the frame bracket may have lateral reinforcements joining the pairs, for example, as shown with rear vertical frame 40 in FIGS. 1 and 2. The lateral reinforcements may be, for example, a one inch pin. Components that are formed in pairs may also, in some embodiments, be joined by a stabilizer plate, for example, a quarter inch flat bar, welded between the pair. Components that are formed in pairs may be, for example, formed of a pair of angle irons that are fastened to a piece of wood, that is for example 2 inches deep by 7 inches wide, by a wood screw or bolt.

Rear vertical frame 40 may attach to the rear extent of lower horizontal frame 42 and upper horizontal frame 48. Central vertical frame 44 may provide a support for pivot pin 15C of pivot 14, and be formed of two pieces of square steel tubing, one on each side of lever arm 12 and flange bearings 15A, 15B. One or both pieces of central vertical frame 44 may attach to lower horizontal frame 42 and upper horizontal frame 48 at approximately midway the length of lower horizontal frame 42 and upper horizontal frame 48, respectively. Central horizontal frame 46 may attach to central vertical frame 44 and rear vertical frame 40. Front vertical frame may attach to the front extent of lower horizontal frame 42 and upper horizontal frame 48.

In some embodiments, the length of components of the frame bracket may be adjustable, in a similar manner to adjustable lever arm 12, as described above.

The components of the frame bracket may stabilize parts of garage door carrier 10, including pivot 14, as lever arm 12 moves between the closed state and the open state.

Sections of top horizontal track 30 and arcuate track 32 may be supported by various components of the frame bracket. For example, top horizontal track 30 may be affixed to a 2 inch by 4 inch angle bracket by a track bolt, which is in turn affixed to upper horizontal frame 48, in some embodiments via a 2 inch by 7 inch piece of wood.

Any of the components of the frame bracket may be reinforced by attachment to a building or structure. For example, lower horizontal frame 42 may be affixed to the ground, for example, anchored into the ground or a floor of a garage in which garage door carrier 10 is installed. Lower horizontal frame 42 may be anchored into concrete or fastened to an anchor, as would be understood by a person skilled in the art. Any of front vertical frame (not shown), rear vertical frame 40, upper horizontal frame 48, central vertical frame 44, and central horizontal frame 46 may be anchored to a garage ceiling. Any of front vertical frame (not shown), rear vertical frame 40, lower horizontal frame 42, upper horizontal frame 48, central vertical frame 44, and central horizontal frame 46 may be anchored to an adjacent wall or support structure, for example, screwed into a wall, anchored to a wall or in a wall stud, as would understood by a person skilled in the art. These attachments to a structure or ground may be fastened by a support angle or bracket, formed of, for example, steel, as would be known by a person skilled in the art.

The components of garage door carrier 10, in particular, the components that move during operation, may be enclosed within a cage or screen (not shown), to limit access to the components, for example, by pedestrians in the garage and may increase the safety of the system by reducing the possibility of items being caught within moving parts.

Garage door carrier 10, as bounded by the frame bracket, may require a footprint that has several (e.g., between 6 and 12, in an embodiment, 7) inches of sideroom. The headroom above garage door 20, namely the minimum distance from the top of garage door 20 to the ceiling of the garage in which it is installed, that is required for garage door carrier 10 to operate may also be several (e.g., between 6 and 12, in an embodiment, 7) inches.

Garage door carrier 10' is generally identical in structure and components to garage door carrier 10, in mirror image such that the structure is reversed, as shown in FIG. 1. The components of garage door carrier 10' include a lever arm 12', a pivot 14', a hinge 16', a hinge mechanism 17', a garage door hinge 22', hinge plates 19A', 19B' a counterweight 18', a top horizontal track 30', an arcuate track 32', a top roller (not shown), a middle roller (not shown), a bottom roller (not shown), a front vertical frame (not shown), a rear vertical frame 40', a lower horizontal frame 42', an upper horizontal frame 48', a central vertical frame 44', a central horizontal frame 46'.

As shown in FIGS. 1 and 2, a bottom strut 50 may attach to and extend between lower horizontal frame 42 and lower horizontal frame 42' and serve to reinforce the frame brackets of each of garage door carrier 10, 10'. Bottom strut 50 may be formed of steel, adjacent to the ground. Bottom strut 50 may be, for example, a steel flat bar that is quarter inch in height and 3 inches wide.

As shown in FIG. 1, at a midpoint along bottom strut 50 halfway between lower horizontal frame 42 and lower horizontal frame 42', an angled stop 54 may be affixed to bottom strut 50. Angled stop 54 is oriented such that a horizontal component is affixed to bottom strut 50 and a vertical component extends vertically at a generally right angle from bottom strut 50. Angled stop 54 may align generally with hinge mechanism 23 on garage door 20, such that when garage door 20 is closed, angled stop 54 acts as a stop for garage door 20 at hinge mechanism 23. As such, angled stop 54 may act to prevent garage door 20 from moving rearwardly when closed, for example, during strong winds. Angled stop 54 may be formed of an angle iron that is a quarter inch thick, 1.5 inches in width and 1.5 inches in height.

In other embodiments, one or more angled stops 54 may be installed at other points along the length of bottom strut 50.

Similarly to bottom strut 50, as shown in FIGS. 1 and 2, a top strut 52 may attach to and extend between upper horizontal frame 48 and upper horizontal frame 48' and serve to reinforce the frame brackets of each of garage door carrier 10, 10'. Top strut 52 may be formed, for example, of angle iron.

In some embodiments, garage door carrier system 100 may comprise only a single garage door carrier 10 or multiple garage door carriers. One or more garage door carriers may be located to one or more sides of the opening, as shown in FIGS. 1 and 2, or in some embodiments garage door carriers may be located at intervals across the opening.

Garage door carrier system 100 and garage door 20 may be installed in conjunction with a lock, as would be known to a person skilled in the art, for example, by using an electronic deadbolt to engage with garage door 20 or one of top horizontal track 30 or arcuate track 32 to inhibit movement of garage door 20 when in the closed position.

In use, garage door carrier system 100 and garage door carrier 10 move between the closed state and the open state, moving garage door 20 between the closed position as shown in FIG. 1, to the open position, as shown in FIG. 2, as guided by top horizontal track 30 and arcuate track 32.

Figure 10:
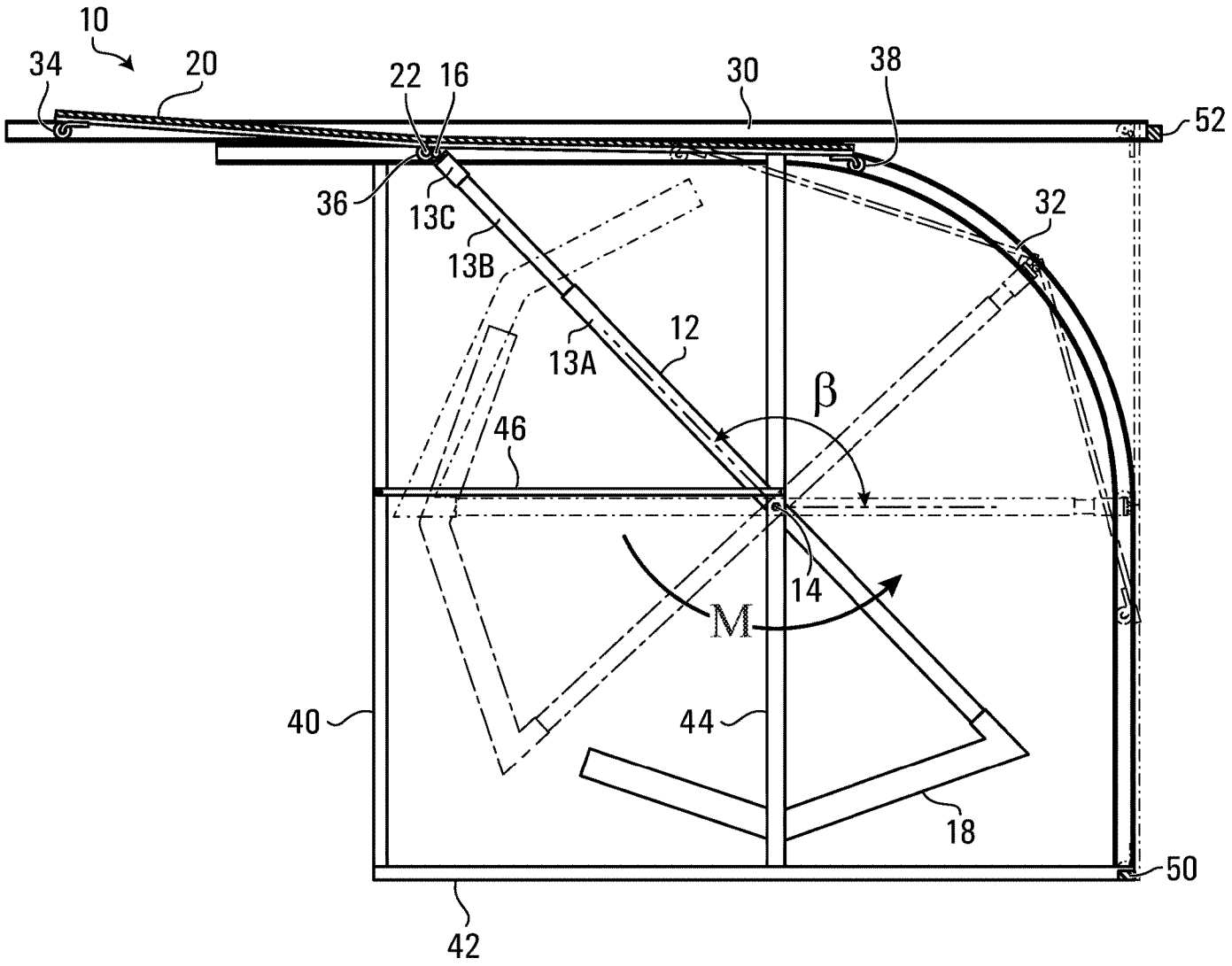
FIG. 10 is a cross-sectional view of the garage door carrier system transformed from the closed state of FIG. 3 to the open state of FIG. 4.

As shown in FIG. 10, in operation, a force is applied to lever arm 12 to provide a moment M about pivot 14 and rotation of lever arm 12, for example, by a motor such as an electric motor (not shown) that is mechanically connected to garage door carrier 10. In some embodiments, moment M may be applied by a force applied at a distance along a moment arm along the length of lever arm 12. Moment M may be operated by machinery, or manually. The operation of garage door carrier system 100 and its components may be controlled by a computerised controller (not shown).

As moment M is applied, lever arm 12 rotates about a generally horizontal axis formed by pivot 14 that is normal or generally orthogonal to the axis of the length of lever arm 12. As garage door carrier 10 rotates, lever arm 12 and counterweight 18 rotate in a vertical plane, generally parallel to the plane or planes in which top roller 34, middle roller 36 and bottom roller 38 travel as garage door 20 rotates between the closed position and the open position, and generally normal to the opening.

The mass of counterweight 18 applies an in-force gravitational force to the in-lever arm of lever arm 12, which extends rearwardly from pivot 14 to counterweight 18. This translates to an out-force at the load end of the out-lever arm of lever arm 12, which extends from pivot 14 to the load end at hinge 16.

The out-force at the load end may assist in applying force to garage door 20 as lever arm 12 rotates about the pivot, to carry garage door 20 between the defined closed position and the defined open position.

As shown in FIG. 10, as lever arm 12 rotates between the closed state and the open state, top horizontal track 30 and arcuate track 32 guide garage door 20 between the closed position and the open position. Garage door 20 articulates at garage door hinge 22 as garage door 20 moves along top horizontal track 30 and arcuate track 32. Reactionary forces of the top horizontal track 30 and arcuate track 32 applied to garage door 20 through top roller 34, middle roller 36, and bottom roller 38 reduce the force applied by garage door 20 to lever arm 12 as the garage door 20 opens.

The angular rotation of the axis of lever arm 12 between the closed state and the open state is shown as obtuse angle $\beta$ in FIG. 10. As with angle $\theta$ shown in FIG. 8, angle $\beta$ carries garage door 20 between the closed position and the open position. In some embodiments, angle $\alpha$ equals angle $\beta$.

As the garage door carrier system 100 moves from the closed state to the open state, the "cog" travels along a circular path urging carrier system 100 into a steady state at the open state.

As shown in FIG. 10, the length of lever arm 12 extends as garage door carrier 10 reaches the open state, and may allow garage door 20 to continue along top horizontal track 30 and arcuate track 32 and garage door carrier system 100 to reach an equilibrium of forces in the open state such the force of the centre of gravity of counterweights 18 and 18' equalizes forces of pivot 14 and 14', garage door 20, and gravity acting on lever arms 12 and 12'. As such, in the open position, garage door 20 is balanced and will remain in the open position without application of an external force.

Garage door carrier system 100 is primarily intended for commercial use, for example, with large underground parking doors. Garage door carrier system 100 eliminates cables, chains and springs used in a standard garage door opener (for e.g., torsion spring components). With fewer moving parts, garage door carrier system 100 may have fewer stress points than traditional garage door openers, which may result in a greater number of open and close cycles before requiring maintenance or repair, leading to less maintenance and downtime and reduced repair and maintenance costs. The reduced moving parts may also result in less skill required to install garage door carrier system 100, and once installed, garage door carrier system 100 may be less likely to go out of balance or out of alignment.

Garage door carrier system 100 may also reduce the noise level of opening and closing garage door 20.

It will be appreciated that the above disclosed garage door carrier system 100 may also be used in conjunction with a traditional garage door opener that is used to move garage door 20 between the closed position and the open position.

The above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A carrier system for carrying a garage door between a defined closed position in which the garage door is generally vertical and blocks entry of a vehicle into a garage through an opening, and a defined open position in which the garage door is generally horizontal and allows entry of the vehicle into the garage through the opening, the carrier system comprising:

a track for guiding the garage door by rolling engagement with the track;

a lever rotatable about a pivot, the lever having an in-lever arm at a first side of the pivot and an out-lever arm at a second, opposing, side of the pivot, the out-lever arm extending from the pivot to a load end, the load end rotatably connected to the garage door; and a counterweight connected to the in-lever arm to provide force at the in-lever arm, translated as force at the load end of the out-lever arm, as the lever rotates about the pivot, to carry the garage door between the defined closed position and the defined open position;

wherein the counterweight is connected to the in-lever arm so that an obtuse angle defined between a reference axis passing through the centre of gravity of the counterweight and the pivot and a vertical axis passing through the pivot is equal to an angle of rotation of the out-lever arm about the pivot as the lever rotates about the pivot to carry the garage door between the defined closed position and the defined open position.

2. The carrier system of claim 1, wherein the obtuse angle is between 120° and 150°.

3. The carrier system of claim 1, wherein the counterweight is connected to the in-lever arm at a mounting angle defined between a reference axis passing through the centre of gravity of the counterweight and the pivot and an arm axis passing through the load end of the out-lever arm and the pivot, and the mounting angle is between 120° and 150°.

4. The carrier system of claim 3, wherein the mounting angle is equal to the obtuse angle.

5. The carrier system of claim 1, wherein the load end of the out-lever arm is generally orthogonal to the garage door in the defined closed position.

6. The carrier system of claim 1, wherein in the defined open position the centre of gravity of the counterweight is aligned with a vertical axis through the pivot.

7. The carrier system of claim 1, wherein the counterweight is at a furthest distance from the pivot that is less than the distance from the pivot to the ground.

8. The carrier system of claim 1, wherein the track for guiding the garage door comprises a top horizontal track portion and an arcuate track portion curving to a vertical track portion extending from ground level.

9. The carrier system of claim 1, wherein the out-lever arm of the lever extends in length as the carrier system moves between the defined closed position and the defined open position.

10. The carrier system of claim 1, wherein in the defined open position the weight of the counterweight acting on the lever equalizes the forces of the pivot, the door, and gravity acting on the lever.

11. The carrier system of claim 1, wherein in the defined closed position the garage door touches the ground.

12. The carrier system of claim 1, wherein the lever rotates about a generally horizontal axis formed by the pivot.

13. The carrier system of claim 12, wherein the counterweight rotates in a vertical plane generally normal to the opening.

14. The carrier system of claim 13, wherein the counterweight is located to one side of the opening.

15. The carrier system of claim 1, wherein the garage door has a plurality of panels and is hinged between two or more of the plurality of panels.

16. A carrier system for carrying a garage door between a defined closed position in which the garage door is generally vertical and blocks entry of a vehicle into a garage through an opening, and a defined open position in which the garage door is generally horizontal and allows entry of the vehicle into the garage through the opening, the carrier system comprising:

a track for guiding the garage door by rolling engagement with the track;

a lever rotatable about a pivot axis, having load end and rotatably interconnected with the garage door to move the garage door on the track;

a counterweight connected to the lever to provide a force at the load end, as the lever rotates about the pivot axis, to carry the garage door between the defined closed position and the defined open position;

wherein said counterweight is mounted so that the center of gravity of the counterweight travels a defined angle between 120° and 150° about said pivot axis, as said door moves from the defined closed position to said defined open position.

17. The carrier system of claim 16, wherein the lever extends in length as the door moves between the defined closed position and the defined open position.

18. The carrier system of claim 16, wherein the garage door has a plurality of panels and is hinged between two or more of the plurality of panels.

19. The carrier system of claim 16, wherein the counterweight rotates in a vertical plane generally normal to the opening.

* * * * *